US009955806B2

(12) United States Patent
Jaeckel

(10) Patent No.: US 9,955,806 B2
(45) Date of Patent: May 1, 2018

(54) COMBINED PLATE AND CUP HOLDER

(71) Applicant: David Jaeckel, South Bend, IN (US)

(72) Inventor: David Jaeckel, South Bend, IN (US)

( * ) Notice: Subject to any disclaimer, the term of this patent is extended or adjusted under 35 U.S.C. 154(b) by 0 days. days.

(21) Appl. No.: 15/354,615

(22) Filed: Nov. 17, 2016

(65) Prior Publication Data

US 2017/0143141 A1 May 25, 2017

Related U.S. Application Data

(60) Provisional application No. 62/257,904, filed on Nov. 20, 2015.

(51) Int. Cl.

| | |
|---|---|
| ***A47G 19/06*** | (2006.01) |
| ***A47G 23/02*** | (2006.01) |
| ***A47G 19/02*** | (2006.01) |

(52) U.S. Cl.

CPC ..... *A47G 19/065* (2013.01); *A47G 19/06* (2013.01); *A47G 23/0225* (2013.01)

(58) Field of Classification Search

CPC ..... A47G 19/065; A47G 19/06; A47G 19/02; A47G 23/0225; A47G 23/0216; A47G 23/0208; B65D 1/36; B65D 1/34; B65D 21/0233

USPC ... 220/575, 574.1, 574, 23.89, 23.87, 23.86, 220/23.83, 556, 737; 206/564, 563, 562, 206/561, 557, 507, 505

See application file for complete search history.

(56) References Cited

U.S. PATENT DOCUMENTS

| | | | | |
|---|---|---|---|---|
| 1,937,939 | A | 3/1933 | Behrens | |
| 3,115,251 | A | 12/1963 | Farrell | |
| 3,257,024 | A | 6/1966 | Semanchik | |
| 3,955,672 | A * | 5/1976 | Brundage | A47G 19/065 206/218 |
| 4,732,274 | A | 3/1988 | Bouton | |
| 5,058,737 | A * | 10/1991 | Patterson | A47G 19/065 206/217 |
| 5,234,125 | A * | 8/1993 | Roberts | A47G 19/065 206/562 |
| 5,259,528 | A | 11/1993 | Pace | |
| 8,444,001 | B1 | 5/2013 | Dawson | |
| 2006/0255050 | A1* | 11/2006 | MacCarthy | A47G 19/065 220/737 |
| 2006/0266748 | A1* | 11/2006 | Crawford | A47G 19/065 220/23.8 |
| 2006/0283754 | A1 | 12/2006 | Shiltz et al. | |
| 2009/0194543 | A1* | 8/2009 | Farmer | B65D 1/36 220/575 |

(Continued)

*Primary Examiner* — Robert J Hicks

(74) *Attorney, Agent, or Firm* — Notre Dame Intellectual Property Clinic

(57) ABSTRACT

A device and method for holding food and drink simultaneously, comprising of a combined plate and adjustable cup holder. The plate may have one or more compartments for holding food and the cup holder is for supporting various drink containers. The plate having an aperture through which the cup holder is situated. The cup holder may move within the aperture with protrusions near the top and bottom of the cup holder to prevent the cup holder from disengaging from the plate. When the cup holder is lowered with respect to the plate, it provides a natural handle. When the cup holder is raised with respect to the plate the base of the cup holder and base of the plate are substantially coplanar, allowing the plate to rest on a flat surface.

10 Claims, 16 Drawing Sheets

(56) References Cited

U.S. PATENT DOCUMENTS

2013/0098923 A1 4/2013 Sandoval

* cited by examiner

COMBINED PLATE AND CUP HOLDER

CROSS-REFERENCES AND PRIORITY CLAIMS

This application claims priority to Provisional Application No. 62/257,904 filed on Nov. 20, 2015 and incorporated herein by reference.

BACKGROUND

During social gatherings, people often consume food and drink while standing or walking around. In these settings, people may find it difficult to hold a plate for food in one hand and a cup for a drink in the other while also engaging socially. With both hands occupied the person cannot shake hands, open doors, or use their cell phone. It can also be difficult for the individual to eat when one hand is occupied holding a drink, and the other hand holds a plate. With both hands occupied, it becomes difficult to socialize without putting down either the food or drink. Furthermore, there can be limited places for individuals in social gatherings to place their food or drink.

Some variations of combination plate and cup holders have been created to address this problem. Many of these variations have tried to meet the same basic goal. This goal is creation of a plate with an attached cup holder, which is easy to hold, and can be placed on a flat surface without the plate or drink tipping over. The existing variations fail to meet one or more features of this goal.

One example is Farrell U.S. Pat. No. 3,115,251 disclosing a "plate and cup holder" having a base supporting a plate and peripheral cup holder extending above the base. When in use, the drink is balanced on top of the base of the invention, with a band encircling the top of the cup to hold it in place. The design is not easy to hold as it has no natural hand-grip. Instead the user must hold the plate from underneath, with their fingers straight and palm up, or with their thumb above the base and the rest of their hand below it. This is no easier to hold than a normal plate and the weight of the drink added to that of the plate makes the plate and cup holder awkward and unwieldy to grip.

Another example is Crawford U.S. patent application Ser. No. 11/138,986 disclosing a "combined plate and cup holder," having a plate with a peripheral, collapsible cup holder extending below the plate. The collapsible cup holder telescopes closed such that the entire device can sit on a flat surface without tilting. However, this design may be difficult to grip, as the telescoping cup holder may collapse closed when grasped independently from the plate. In fact, there is no natural hand-grip and the user holds the device from the edge of the plate, or underside of the plate. Additionally, Crawford does not address the problem of the drink tipping when the plate is set on a flat surface. When the plate is set down, the cup holder telescopes closed, such that the drink extends above the surface of the plate, with no substantial sidewall to prevent tipping and spilling of the drink. Thus, movement of the plate could easily displace, and spill the drink.

SUMMARY

The following presents a simplified summary in order to provide a basic understanding of some aspects of the claimed subject matter. This summary is not an extensive overview. It is not intended to either identify key or critical elements or to delineate the scope of the claimed subject matter. Its sole purpose is to present some concepts.

The combined plate and cup holder is directed to a device that satisfies the need for a combined plate and cup holder, which is easy to hold, and can be placed on a flat surface without the plate or drink tipping over. One embodiment describes a device for holding food and drink, the device comprising a cup holder with fixed sides and a base. The cup holder is configured to support a variety of drink containers. The device also comprises a plate for supporting food. The plate comprises an aperture through which the cup holder is moveable within the aperture, and the device may be disposed in a lowered position, where the cup holder is lowered with respect to the plate, or in a raised position, where the base of the cup holder is substantially coplanar with the base of the plate.

In this first embodiment, the aperture of the plate may be located substantially near the center of the plate, or near a periphery of the plate. The combined plate and cup holder is also constructed of material selected from the group consisting of polymers and molded fiber.

In an embodiment, one or more protrusions are located substantially near the bottom of the cup holder, and those protrusions abut the edge of the aperture when the device is in the raised position. This prevents the cup holder from disengaging with the aperture.

The device, in an embodiment, may also comprise of a plate that is separated into sections by one or more partitions. The device may also comprise of an indentation in the bottom of the plate, where the indentation surrounds the aperture. This allows for a channel around the cup holder, so that a hand can easily grasp the cup holder from underneath. This device may also comprise of one or more bumps along the lip of the cup holder, where the bump abuts the edge of the aperture when the device is in the lowered position. This prevents the cup holder from disengaging in the aperture.

The device in an embodiment may also comprise of a locking mechanism such that the plate is configured to lock in fixed position with respect to the cup holder. The device may also comprise of a wall protruding from the plate, along the perimeter of the aperture. The wall stabilizes the cup holder when the device is in the raised position.

A method for using a device suitable for holding food and drink may comprise of obtaining a combined plate and cup holder, where the cup holder has fixed sides and a base, and the plate comprises an aperture through which the cup holder is positioned to move up and down within the aperture. This method includes lifting of the plate portion from the combined plate and cup holder so that the cup holder lowers with respect to the plate, disposing the device into a lowered position. The steps of this method also comprise lowering the combined plate and cup holder onto a surface, so that the cup holder moves up with respect to the plate, and the base of the cup holder sits substantially coplanar with the base of the plate so that the device is disposed into a raised position.

In that method for using the combined plate and adjustable cup holder, the food may be stored on the plate, a drink container may be stored in the cup holder, or both food and drink may be stored simultaneously wherein the food may be stored on the plate and the drink container may be stored in the cup holder.

To the accomplishment of the foregoing and related ends, certain illustrative aspects of the claimed subject matter are described herein in connection with the following description and the annexed drawings. These aspects are indicative of various ways in which the subject matter may be practiced, all of which are intended to be within the scope of the claimed subject matter. Other advantages and novel features may become apparent from the following detailed description when considered in conjunction with the drawings.

BRIEF DESCRIPTION OF THE DRAWINGS

The device and methods may be better understood by referring to the following description in conjunction with the accompanying drawings, in which like numerals indicate like structural elements and features in various figures. The components in the figures are not necessarily to scale, and simply illustrate the principles of the device. The accompanying drawings illustrate only possible embodiments of the device and are therefore not to be considered limiting in scope.

DETAILED DESCRIPTION

Aspects of the system and methods are described below with reference to illustrative embodiments. The references to illustrative embodiments below are not made to limit the scope of the claimed subject matter. Instead, illustrative embodiments are used to aid in the description of various aspects of the systems and methods. The description, made by way of example and reference to illustrative reference is not meant to being limiting as regards any aspect of the claimed subject matter.

Figure 1:
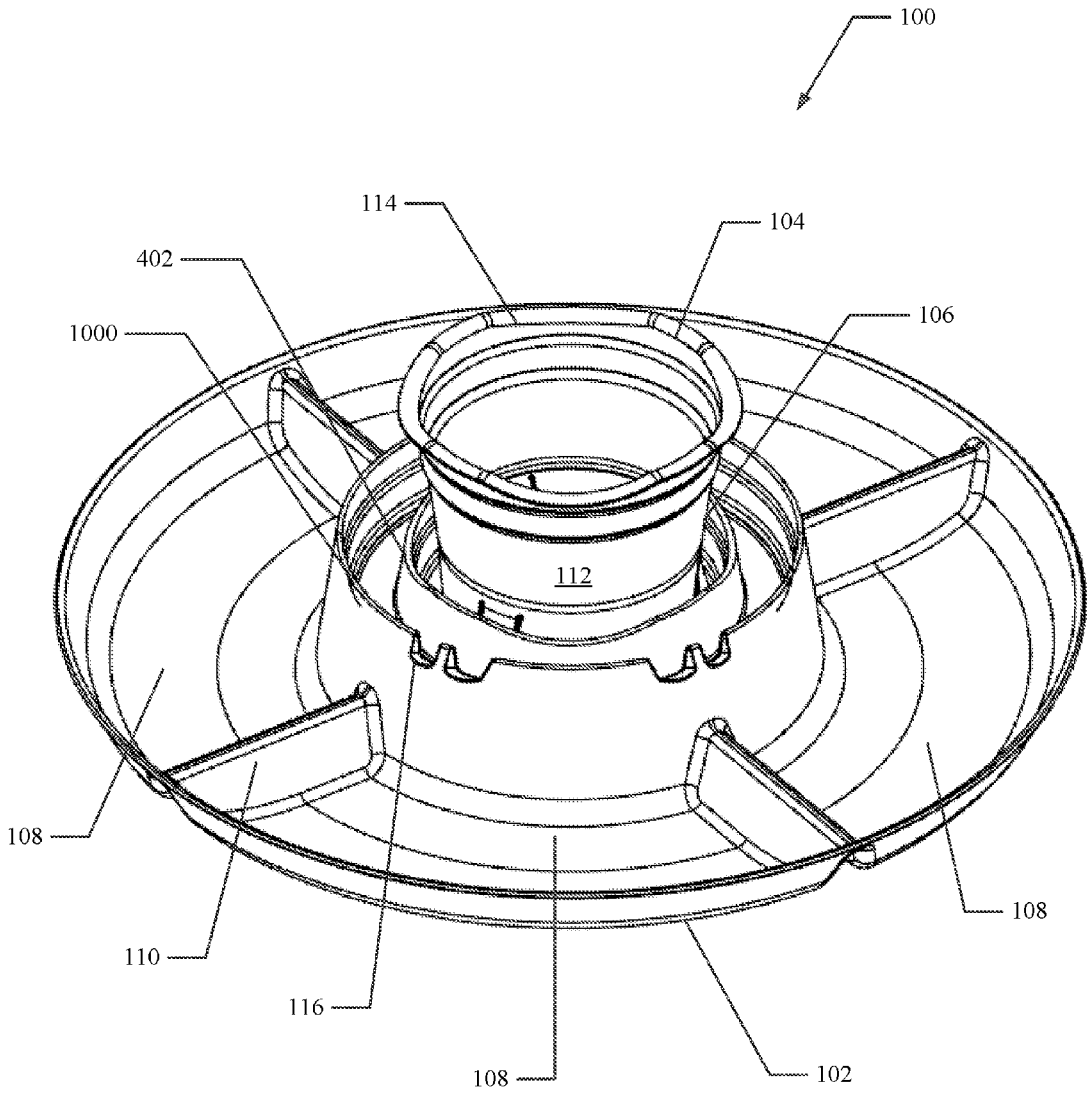
FIG. 1 depicts a perspective view, from above, of an embodiment of the combined plate and cup holder, wherein the cup holder is in the raised position.

Referring to FIG. 1, a combined plate and cup holder 100 is illustrated. The plate 102 is intended for holding food, while the cup holder 104 is capable of holding a variety of beverage containers, including but not limited to cups. The cup holder 104 is positioned within an aperture 106 in the plate 102 and is moveable vertically, and rotationally, within the aperture 106. The combined plate and cup holder 100 can be held with one hand, leaving the other hand free to engage with others in a social gathering or to pick up food or drink from the combined plate and cup holder 100. While being held by the user, the cup holder 104 slides downward with respect to the plate 102 within the aperture 106, referred to herein as the "lowered position." This gives the user an easy and natural grip around the cup holder 104 while holding the combined plate and cup holder 100. Additionally, the user can place the combined plate and cup holder 100 on a generally flat surface and the cup holder 104 will slide upward within the aperture 106 until the combined plate and cup holder 100 is disposed in a raised position, wherein the cup holder 104 is raised with respect to the plate 102, and a base of the plate 300 and a base of the cup holder 302 are substantially coplanar and resting atop the generally flat surface. This allows the combined plate and cup holder 100 to sit atop the surface stably. In the illustrated embodiment, the aperture 106 is sized so that the cup holder 104 fits securely within the aperture 106 and the combined plate and cup holder 100 is stable in the raised position, the lowered position, and while transitioning between these two positions.

Figure 2:
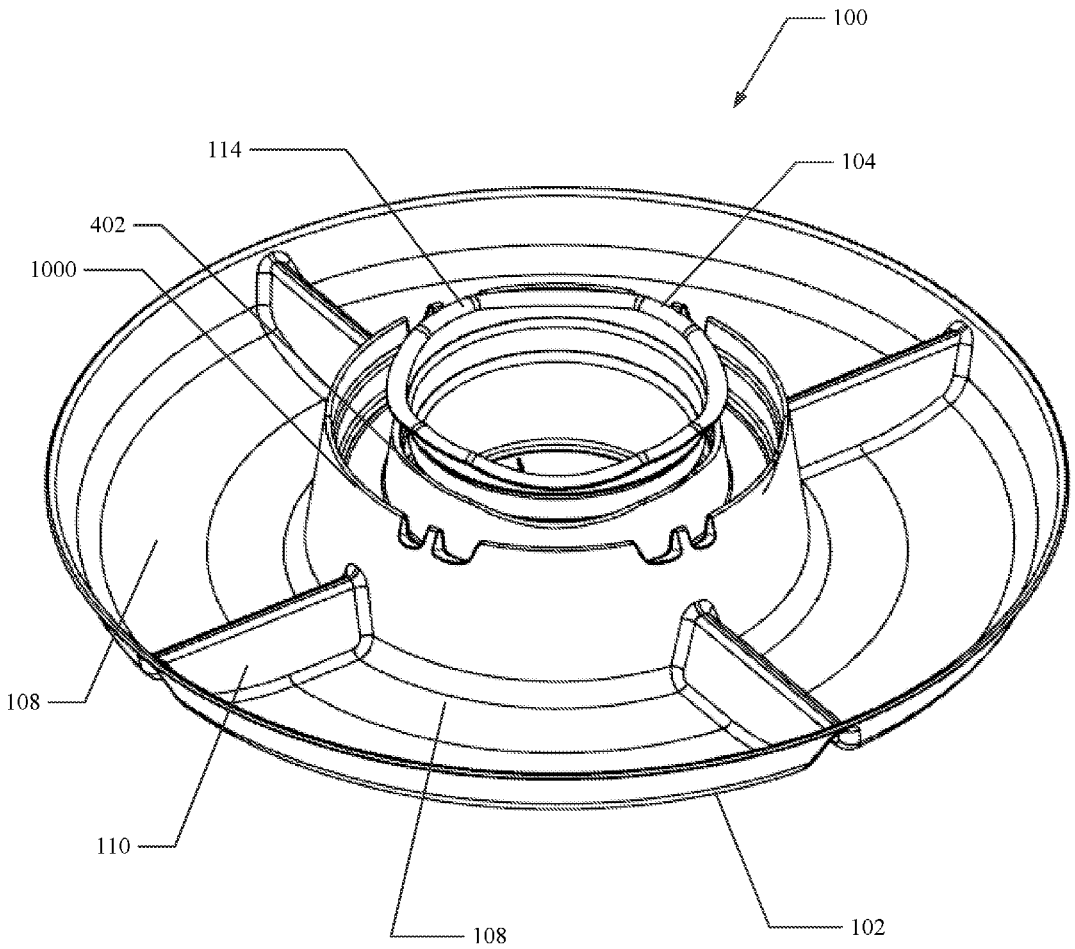
FIG. 2 depicts a perspective view, from above, of an embodiment of the combined plate and cup holder, wherein the cup holder is in the lowered position.
Figure 3:
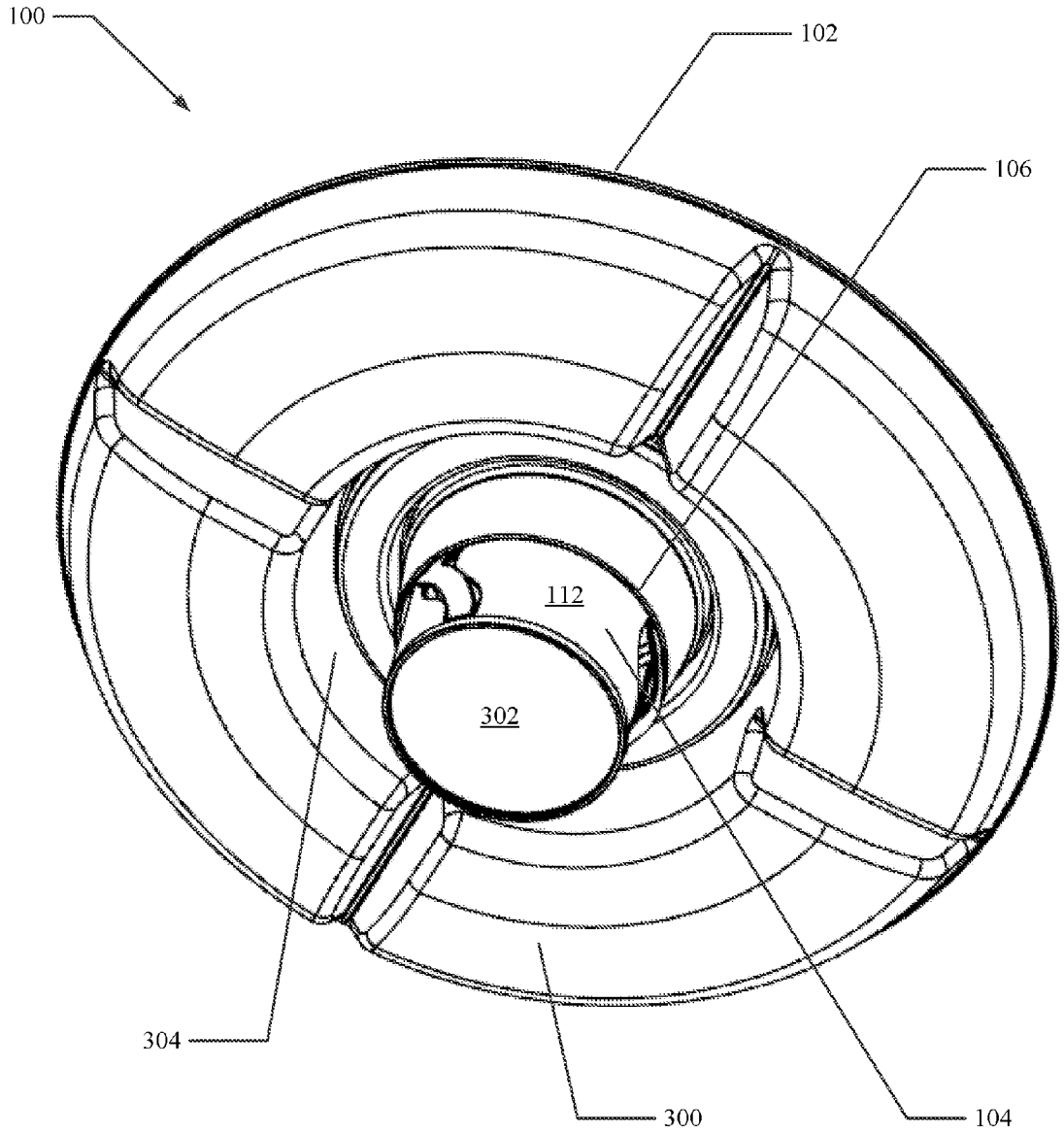
FIG. 3 depicts a perspective view, from below, of an embodiment of the combined plate and cup holder, wherein the cup holder is in the lowered position.

One embodiment of the combined plate and cup holder 100 is shown in FIGS. 1-6. Referring to FIG. 1, the illustrated embodiment includes the circular plate 102 that has multiple compartments 108 for holding food or utensils, separated by one or more dividers 110. While the plate 102 is shown with four compartments 108 and four dividers 110, the compartments 108 and dividers 110 are no necessary and any suitable number of compartments or dividers can be used. In embodiments, the plate 102 is generally flat, with a substantially planar plate base 300 (as best seen in FIG. 3) and a raised outer rim. The plate 102 has an aperture 106 substantially near its center and the cup holder 104 is seated and moveable within the aperture 106. The cup holder 104 has fixed sides 112, a substantially planar cup holder base 302 (as best seen in FIG. 3), and in the depicted embodiment, a lip 114 around its rim. The sides 112 of the cup holder 104 include engagement flanges 400 (shown in FIGS. 4*a* and 4*b* and as described with respect to FIG. 7 below), that assist in controlling the motion of the cup holder 104 relative to the plate 102. The cup holder 104 is suitable to hold a variety of cups, bottles, cans, and other drink containers. As is better seen in FIG. 3, the plate 102 comprises an indentation 304 proximate to, or surrounding the aperture 106 that facilitates gripping the cup holder 104 and potentially the plate 102 from below to support the combined plate and cup holder 100. In other embodiments, the plate 102 may be flat, without any indentation 304.

Turning again to FIG. 1, the combined plate and cup holder 100 is shown in the raised position, where the cup holder base 302 is substantially coplanar with the plate base 300. In this position the base of the cup holder 302 and the base of the plate 300 create a large, generally flat surface that allows the combined plate and cup holder 100 to sit stably atop a table, tail gate, or other generally flat surface. As shown in FIG. 5*b* below, a drink container 500, such as a cup or bottle, can sit easily within the cup holder 104 and is held in place by the fixed sides 112 of the cup holder 104, ensuring that the drink container 500 does not tip over and spill the liquid within the cup holder 104.

Referring to FIGS. 2 and 3, the combined plate and cup holder 100 is disposed in the lowered position. In this position, the cup holder 104 is lowered with respect to the plate 102 so that a wall 402 of the plate 102 (as described with respect to FIG. 4 below) is abutting the lip 114 of the cup holder 104 and the base of the cup holder 302 projects below the plane of the base of the plate 300 (FIG. 3). In embodiments, the lip 114 of the cup holder 104 is greater in size or diameter than the size or diameter of the aperture 106. As a result, the cup holder 104 cannot simply slide through the aperture 106 and out the other side. If a user grasps the plate 102, the cup holder 104 can be suspended from the plate 102 by the lip 114, retaining the drink container 500.

Figure 9:
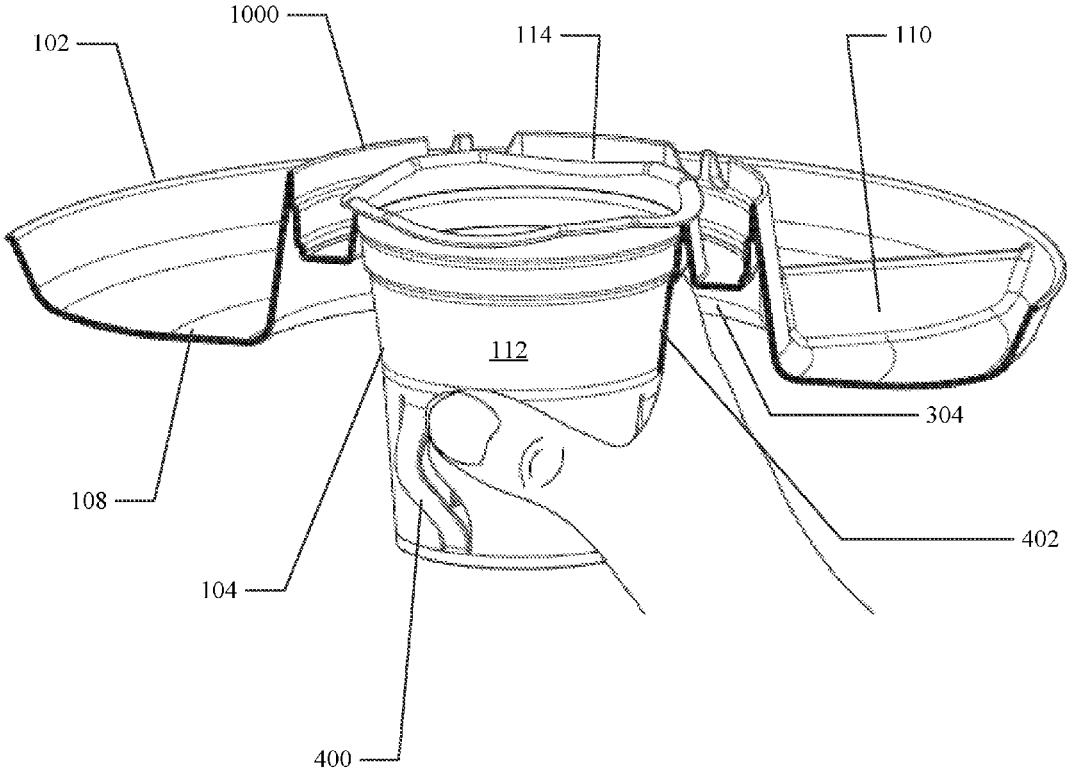
FIG. 9 depicts a cross-sectional view, of an embodiment of the combination plate and cup holder, wherein a hand is grasping the cup holder in the lowered position.

As can be seen in FIG. 3, when the combined plate and cup holder 100 is in the lowered position the bottom portion of the cup holder 104 extends through the aperture 106 below the plate 102. This portion of the cup holder 104 can be grasped by a user, as shown in FIG. 9 below. In the illustrated embodiment, the dividers 110 are hollow and formed from the bends or channels in the plate 102. However, the dividers can be solid, separate from the plate 102 or even removable. The plate 102 can also include an indentation 304 proximate to and around the aperture 106. As shown this indentation 304 can be a channel surrounding the aperture 106 that allows the user's hand to grasp the cup holder 104 and plate 102 comfortably from below. In embodiments, the indentation 304 is sized to allow an adult hand sufficient space to comfortably grasp the cup holder 104 and potentially the wall 402 of the plate 102 with multiple fingers.

Figure 4A:
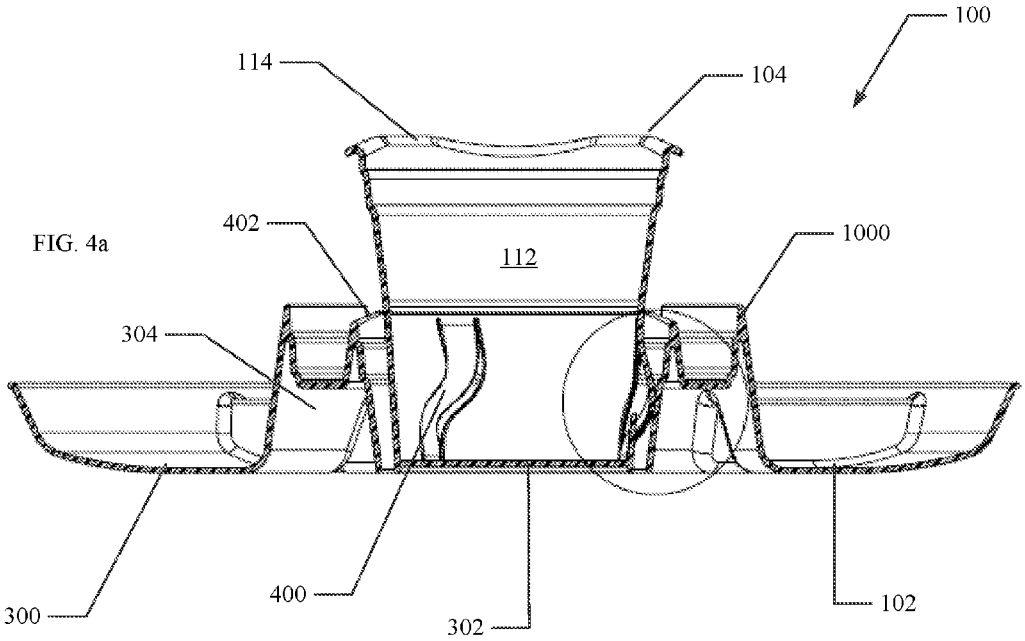
FIG. 4*a* depicts a cross sectional view of the combined plate and cup holder.
Figure 4B:
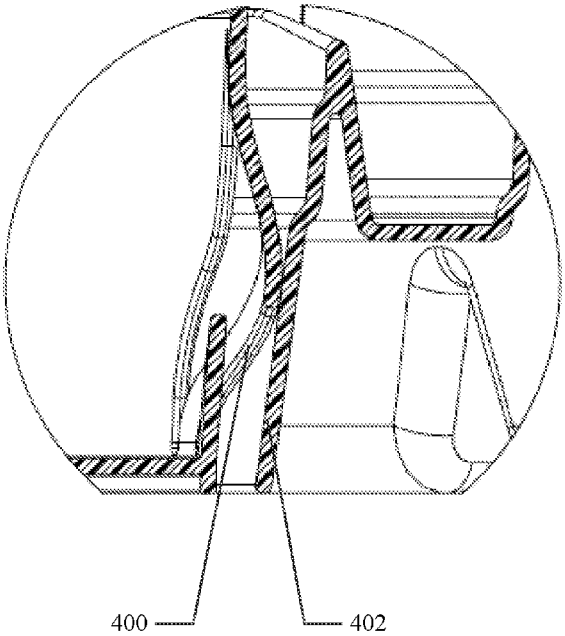
FIG. 4*b* depicts the close up view from the embodiment of FIG. 4*a*, illustrating an embodiment of the engaging mechanism.
Figure 6:
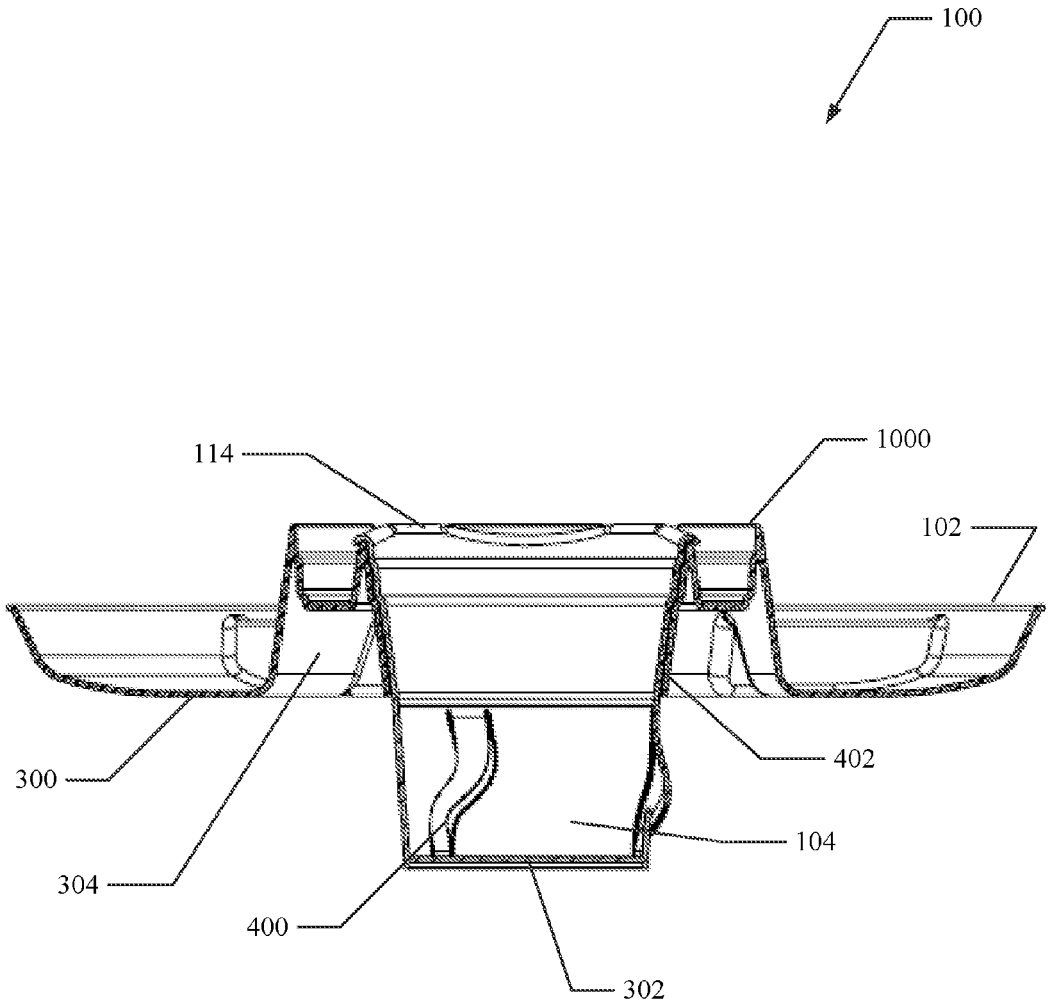
FIG. 6 depicts a cross sectional view of an embodiment of the combination plate and cup holder, wherein the cup holder is in the lowered position.
Figure 11A:
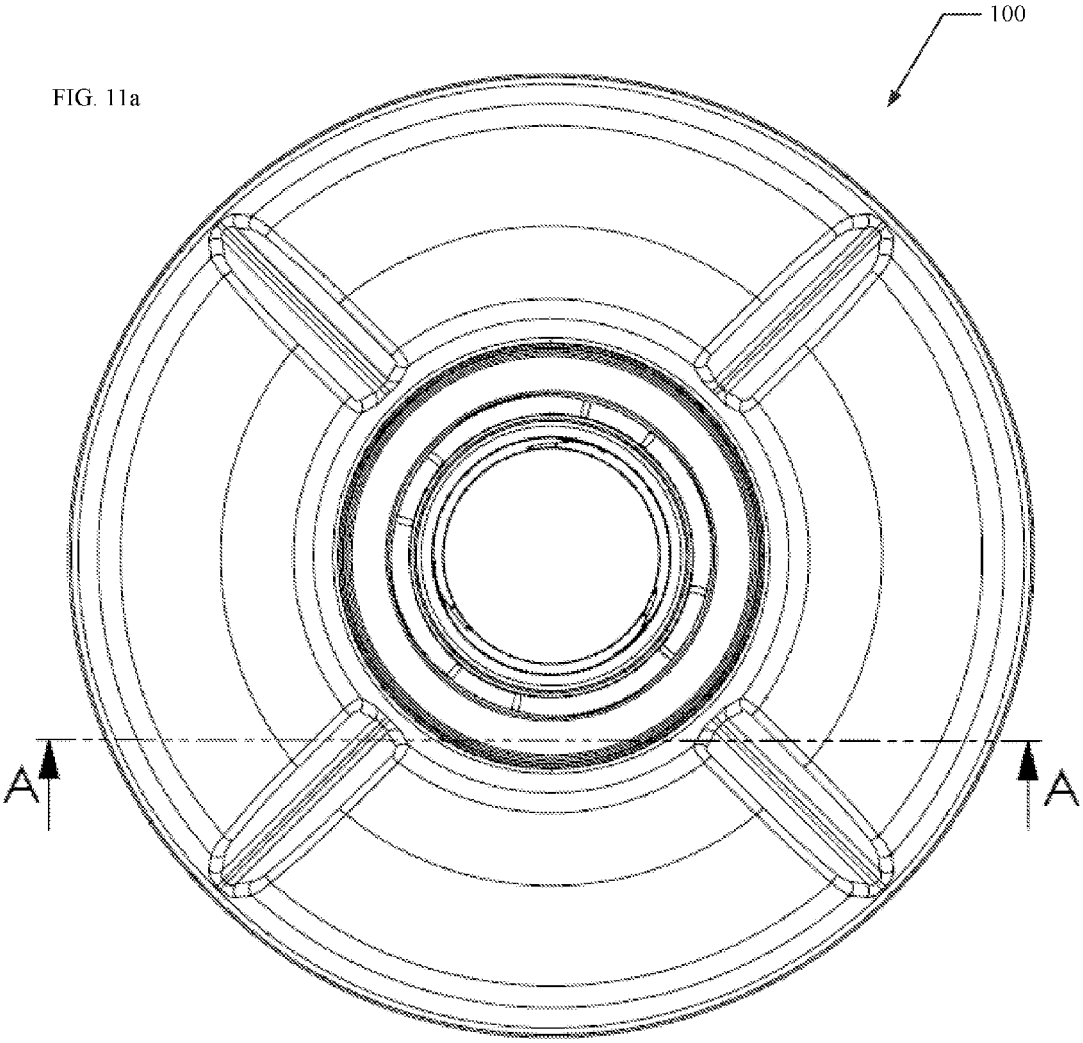
FIG. 11*a* depicts an embodiment of the combination plate and cup holder, wherein a locking mechanism is in use, and indicates by line A the position of the cut away view as seen in FIG. 11*b*.

Referring to FIGS. 4*a* and 4*b*, in embodiments, the plate 102 includes a wall 402 along the perimeter of the aperture 106. This wall 402 can include a portion of a locking mechanism, discussed below with respect to FIGS. 11*a* and 11*b*. As shown when the combined plate and cup holder 100 is in the raised position, the wall 402 provides support for the fixed sides 112 of the cup holder 104, helping to stabilize the cup holder 104 within the aperture 106 of the plate 102. The wall 402 interacts with the engagement flanges 400 as described in more detail with respect to FIG. 7 below. As shown, the engagement flanges 400 engage the wall 402 and may slow movement of the cup holder 104 with respect to the wall 402 and the plate 102, preventing accidental disengagement of the cup holder 104 with the plate 102, and can also stabilize the cup holder 104 within the aperture 106. Referring to FIG. 6, the wall 402 abuts the lip 114 of the cup holder 104 when the combined plate and cup holder 100 is in the lowered position, preventing the cup holder 104 from sliding out of the aperture 106. In other embodiments, the sides 112 of the cup holder 104 can include one or more tabs proximate to the base of the cup holder 302 that prevent the cup holder 104 from accidentally disengaging from the plate 102.

Figure 5A:
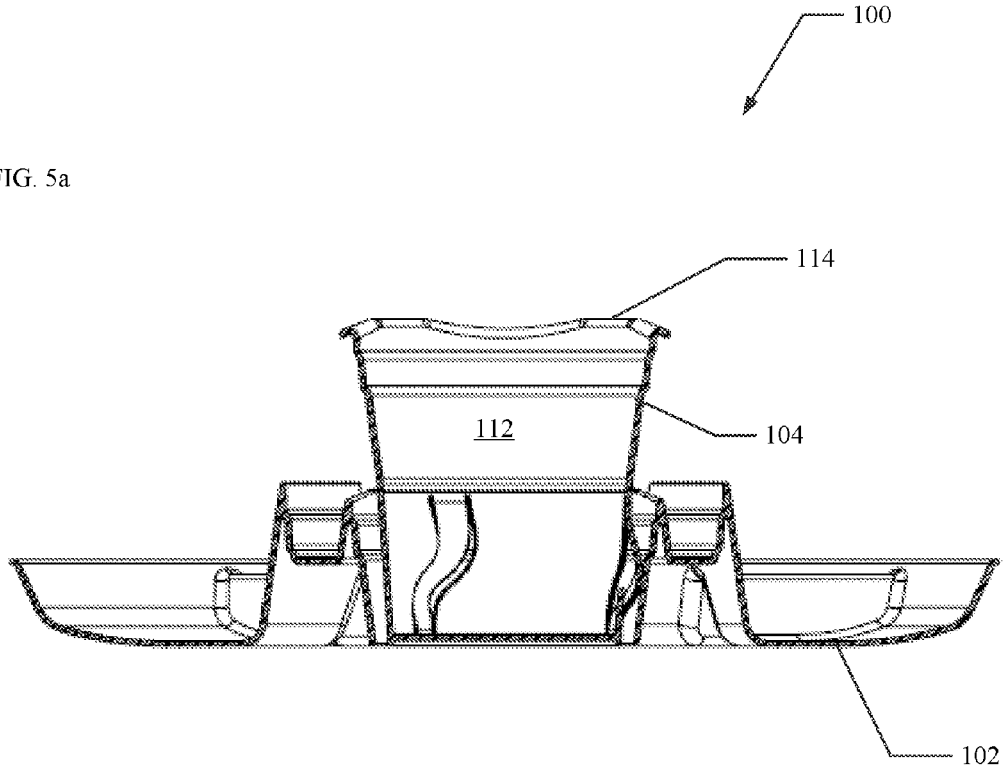
FIG. 5*a* depicts a cross sectional view of an embodiment of the combination plate and cup holder, wherein the cup holder is in the raised position.
Figure 5B:
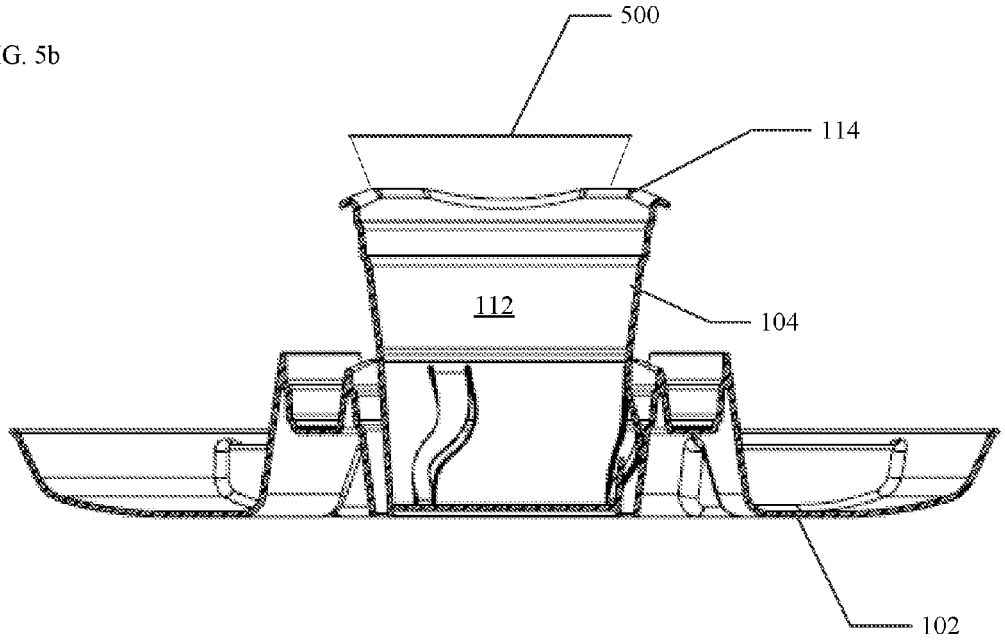
FIG. 5*b* depicts a cross-sectional view of an embodiment of the combination plate and cup holder, with a cup in place in the cup holder.

FIGS. 5*a* and 5*b* depict a cross-section of the combined plate and cup holder 100 in the raised position, with FIG. 5*b* showing a drink container 500, such as a cup, within the cup holder 104. FIG. 6 depicts a cross-section of the combined plate and cup holder 100 in the lowered position. As shown, the drink container 500 is well supported by the fixed sides 112 of the cup holder 104 both while the cup holder 104 is in the raised position, as well as when the cup holder 104 is in the lowered position with respect to the plate 102. FIG. 6 clearly shows the portion of the cup holder 104 and wall 402 of the plate 102 extending below the top of the plate surface and easily graspable by the user. FIG. 6 also clearly shows the lip 114 of the cup holder 104 engaging the top of the wall 402 of the plate 102 to ensure that the cup holder 104 does not simply slide through the aperture 106 and out of engagement with the plate 102.

Figure 7:
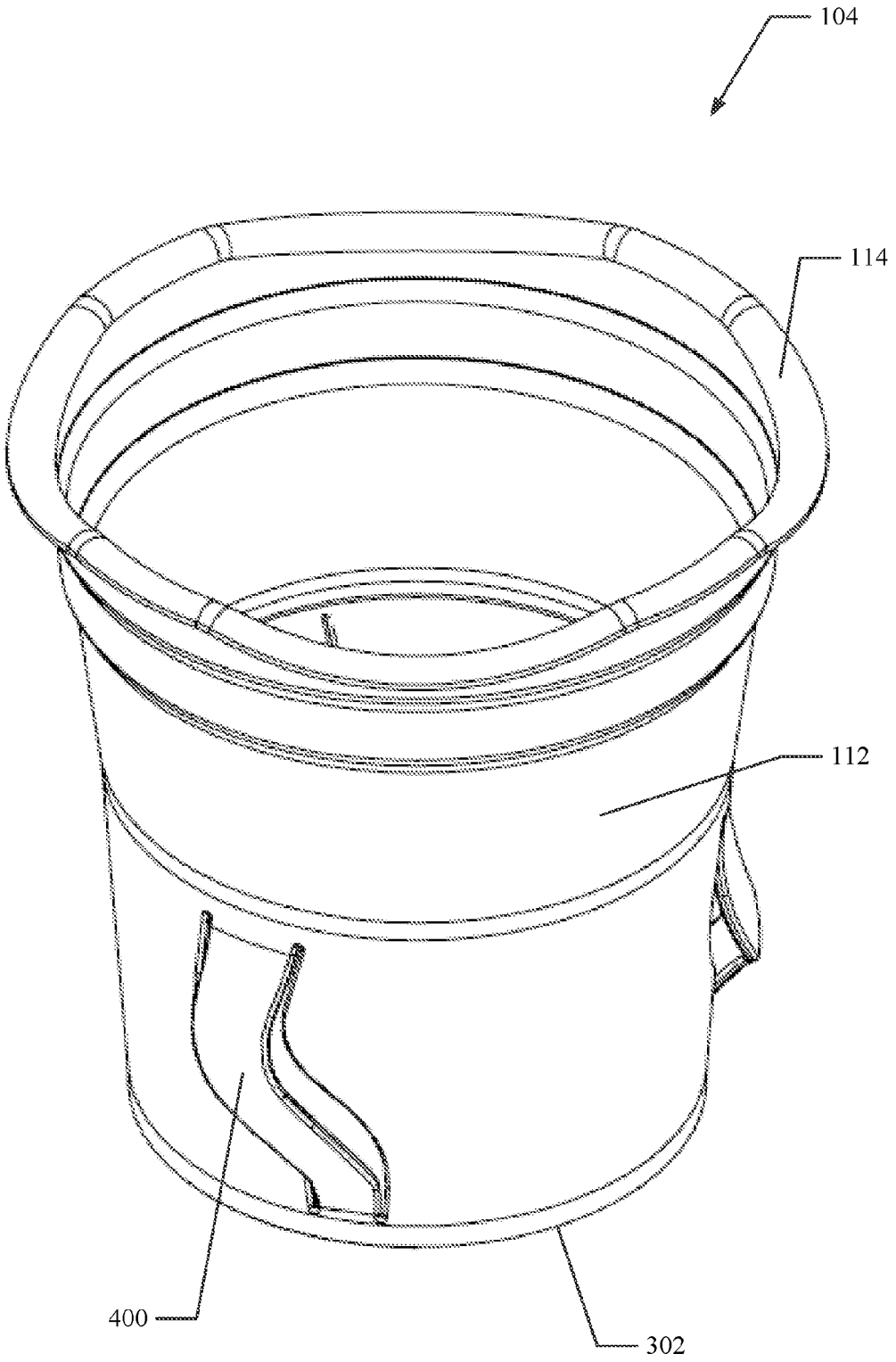
FIG. 7 depicts a perspective view, from above, of an embodiment of the cup holder disengaged from the plate.

Referring to FIG. 7, in this embodiment the cup holder 104 is disengaged from the plate 102, which may aid in ease of cleaning and storing. In embodiments, the cup holder 104 can be larger in diameter at the top, allowing for larger drink containers or containers of dipping sauce, and can narrow near the base 302 to reduce the movement of thinner bottles or drink containers within the cup holder 104. In embodiments, the cup holder 104 can be removed from the combined plate and cup holder 100 by raising the cup holder 104 and lifting it out of the aperture 106. As separate pieces, the cup holder 104 and plate 102 may be sized to fit conveniently within a standard dishwasher and standard cupboards. In addition, the disassembled state of the combined plate and cup holder 100 may be easier to transport or store for sale, though the combined plate and cup holder 100 may also be stackable and transported or stored with combined plate and cup holders 100 simply aligned and placed on top of each other.

Figure 8:
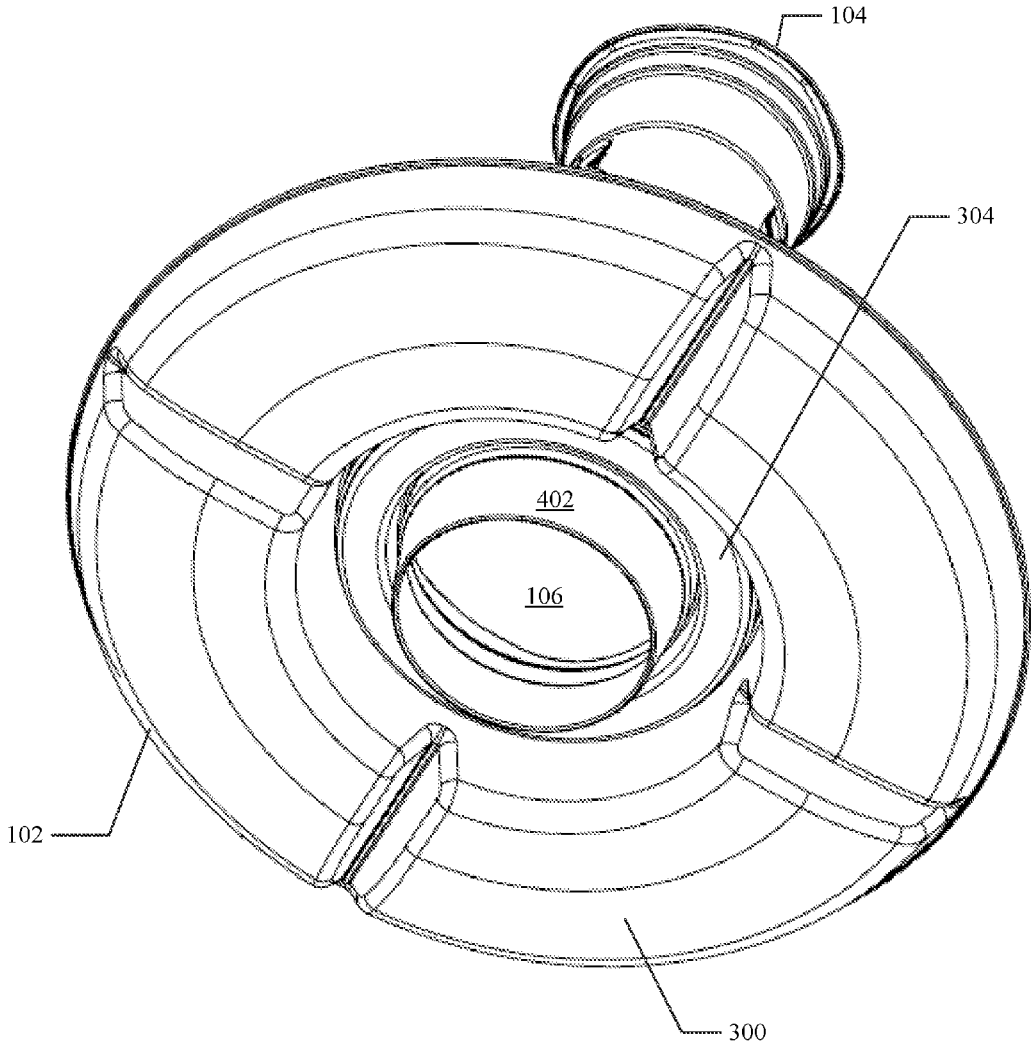
FIG. 8 depicts a perspective view, from below, of an embodiment of the plate disengaged, from the cup holder.

In the illustrated embodiment, the fixed sides 112 of the cup holder 104 include one or more engagement flanges 400. The engagement flanges 400 interact with the wall 402 of the aperture 106 when the combined plate and cup holder 100 is in the raised position, pushing against the wall 402 to prevent the cup holder 104 from disengaging with the plate 102 by mistake, as shown in FIGS. 4*a* and 4*b*. With sufficient force, the engagement flanges 400 can flex, decreasing the effective diameter of the cup holder 104, and the components of the combined plate and cup holder 100 can disengage, as shown in FIG. 8. In other embodiments, when sufficient force is applied, whether or not the engagement flanges 400 flex, the static frictional that holds the engagement flanges 400 and wall 402 in place are overcome to disengage the cup holder 104 from the plate 102. In the illustrated embodiment, the engagement flanges 400 are flexible and act as springs. As the cup holder 104 with the engagement flanges 400 slides up ward within the aperture 106, the engagement flanges 400 reach the wall 402 of the aperture 106. Pressure from the wall 402 of the aperture 106 causes the engagement flanges 400 to flex and allows the cup holder 104 with engagement flanges 400 to slide within the aperture 106. But the force caused by compressing the engagement flanges 400 resists the upward slide of the cup holder 104. The user can exert sufficient pull to overcome this resistance and disengage the cup holder 104 from the aperture 106, but the resistance generated by the engagement flanges 400 assists in ensuring the cup holder 104 is not unintentionally disengaged from the plate 102. In addition, the force exerted by the engagement flanges 400 keeps the cup holder 104 from wobbling within the aperture 106 while the combined plate and cup holder 100 is in the raised position.

Referring to FIG. 8, in this embodiment, the cup holder 104 is shown disengaging from the plate 102. The combined plate and cup holder 100 disengages from the raised position when the user supplies sufficient force either downward on the plate 102 or upward on the cup holder 104. The combined plate and cup holder 100 may be disengaged for ease of cleaning and storing. In embodiments, the engagement flanges 400 ensure that the cup holder 104 does not disengage too easily, resulting in accidental disengagement and potential spills or mess. In another embodiment, the cup holder 104 can include one or more tabs near the bottom of the cup holder 104 that extend outward and engage the bottom of the wall 402 of the plate 102 to prevent the cup holder 104 from accidentally disengaging with the plate 102.

Referring to FIG. 9, the user is holding an embodiment of the combined plate and cup holder 100. The hand of the user rests comfortably in the indentation 304 of the plate 102 in this embodiment. The indentation 304 is adjacent to, or in embodiments, surrounds the sides 112 of the cup holder 104 when the combined plate and cup holder 100 is in the lowered position, allowing the user to easily grasp a larger portion of the cup holder 104. In other embodiments, as shown in FIG. 9, the wall 402 of the plate 102 extends along the fixed sides 112 of the cup holder 104 and the user can grasp the wall 402 of the plate 102, the fixed sides 112 of the cup holder 104 or a combination thereof. When using the combined plate and cup holder 100, the user can maintain a natural wrist and forearm position, where the user's palm is generally perpendicular to the plate 102, rather than the user's palm facing up or down. Some existing combination plate and cups have a user hold the plate with their palm facing up—this is not a natural way to hold something as the forearm and wrist are twisted outward and become uncomfortable after a few minutes. The design of the illustrated combined plate and cup holder 100 reduces stress on the user's hand, wrist and forearm by allowing a natural grasping motion and by distributing the weight of the plate 102 evenly. The combined plate and cup holder 100 provides excellent control in balancing the plate 102, food and drink.

The user of the combined plate and cup holder 100 may utilize the combined plate and cup holder 100 by placing food and utensils on the plate 102 and by placing a beverage container in the cup holder 104. The combined plate and cup holder 100 allows the user to hold both food and drink with one hand, freeing up their other hand to be used for other purposes. When the user is holding the combined plate and cup holder 100, the cup holder 104 is disposed in the lowered position. The user may lift the food or utensils off of the plate 102 or lift the drink container out of the cup holder 104 with the free hand when the user desires to eat or drink. When the user wishes to put the combined plate and cup holder 100 down, the user may set the combined plate and cup holder 100 on a substantially flat surface. When the base of the cup holder 302 engages with the surface, the plate 102 will lower with respect to the cup holder 104 until the base of the plate 300 is substantially coplanar with the base of the cup holder and the combined plate and cup holder 100 is disposed in the raised position. The engagement flanges 400 prevent accidental removal of the cup holder 104 from the plate 102, and stabilize the cup holder 104 during this transition. The combined surface area of the base of the cup holder 302 and the base of the plate 300 sit substantially atop the surface, allowing the combined plate and cup holder 100 to stably sit upon the surface. When the user desires to pick the combined plate and cup holder 100 up again, the user may lift the plate 102. The plate 102 will rise with respect to the cup holder 104 until the wall 402 of the plate 102 abuts the lip 114 of the cup holder 104, disposing the combined plate and cup holder 100 in the lowered position. The fixed sides 112 of the cup holder 104 support a drink container when the combined plate and cup holder 100 is in the raised position, the lowered position, and while the combined plate and cup holder 100 is transitioning between the raised and lowered positions.

Figure 10:
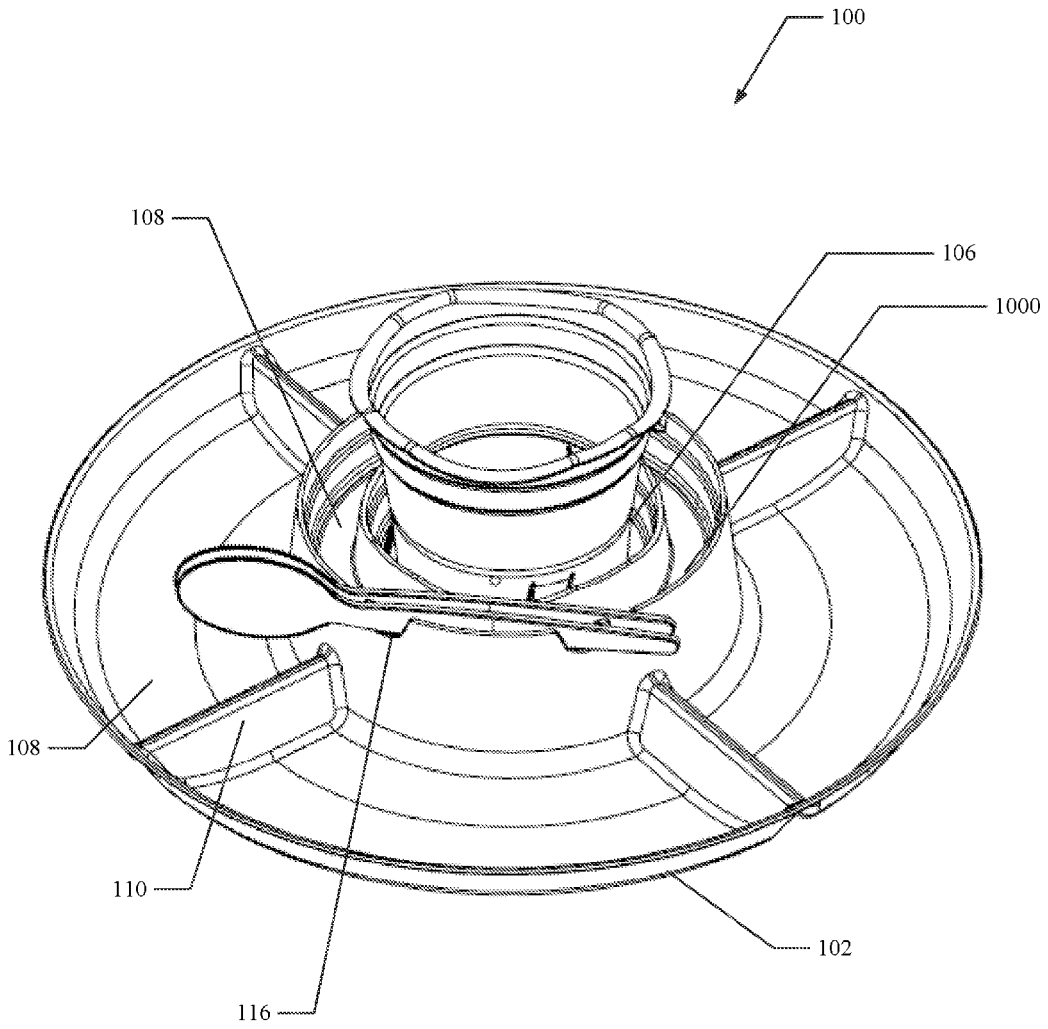
FIG. 10 depicts a perspective view, from above, of an embodiment of the combination plate and cup holder, wherein the utensil holder is in use.

Referring to FIG. 10, in this embodiment the combined plate and cup holder 100 provide an additional feature capable of holding eating utensils, such as a spoon, knife, fork or, of course, a spork. The plate 102 includes a compartment 108 surrounding the aperture 106. The compartment comprises a ridge 1000 that projects upwardly from the plate 102. The ridge 1000 includes one or more cutouts 116 configured to hold eating utensils. The cutout 116 eliminates or reduces the problems of eating utensils sliding off the plate 102 entirely, or sliding so that the handle of the eating utensil falls into the food, making the handle awkward to grasp or contaminating the food with germs or dirt from the handle. The cutout 116 holds the handle of the eating utensil out of the food itself and retains the eating utensil on the plate 102.

Figure 11B:
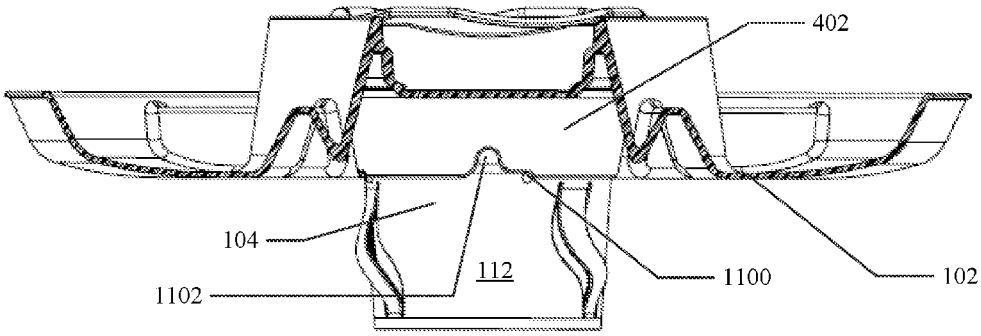
FIG. 11*b* depicts a cutaway view of the embodiment of the combination plate and cup holder as seen in FIG. 11*a*, along line A, wherein an embodiment of the locking mechanism is in use.
Figure 12A:
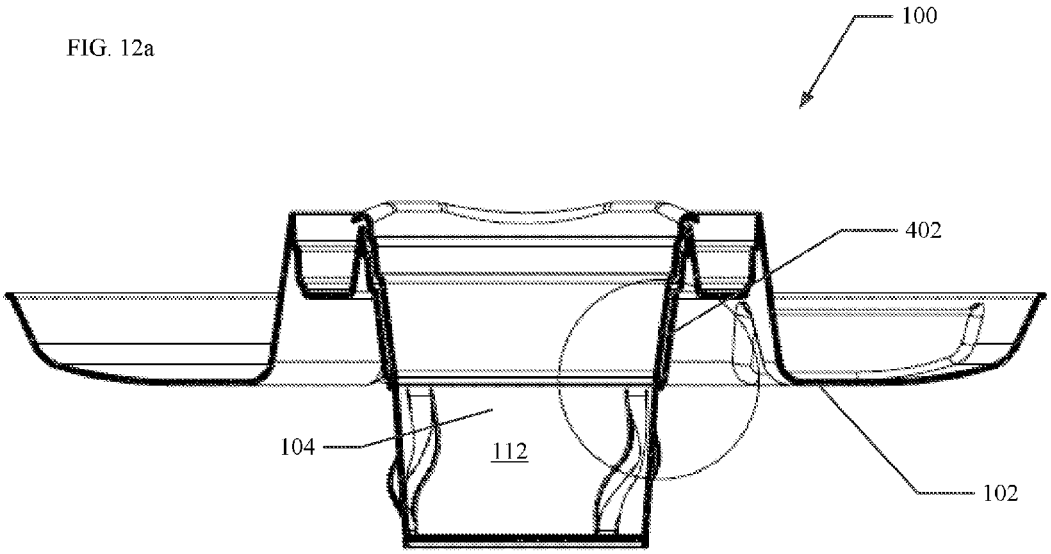
FIG. 12*a* depicts a cross sectional view of an embodiment of the combination plate and cup holder, wherein and embodiment of the locking mechanism is in use.
Figure 12B:
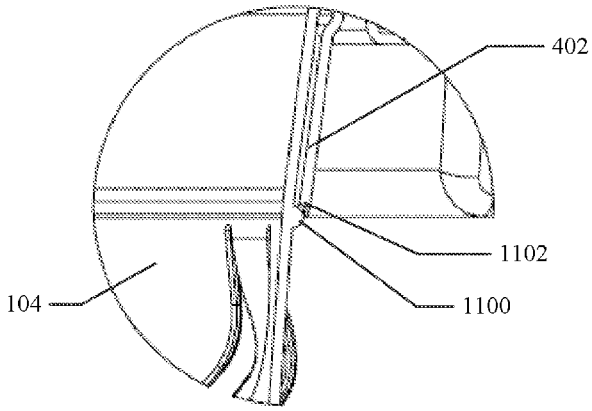
FIG. 12*b* depicts the close up view from the embodiment of FIG. 12*a*, illustrating an embodiment of the locking mechanism.
Figure 13A:
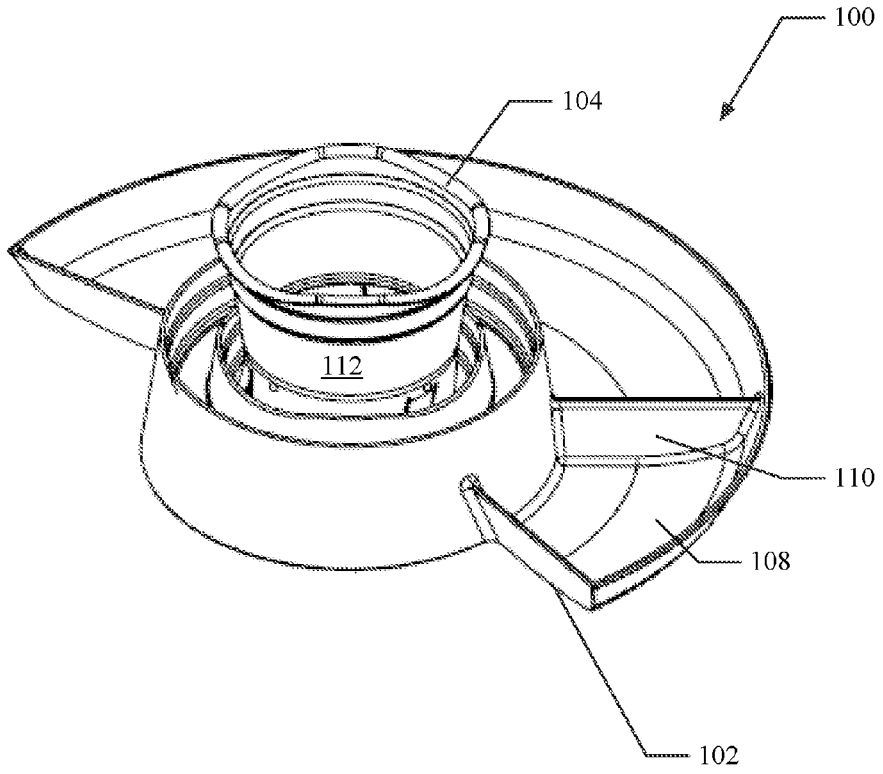
FIG. 13*a* depicts a perspective view of another embodiment of the combination plate and cup holder, with the cup holder in the raised position.
Figure 13B:
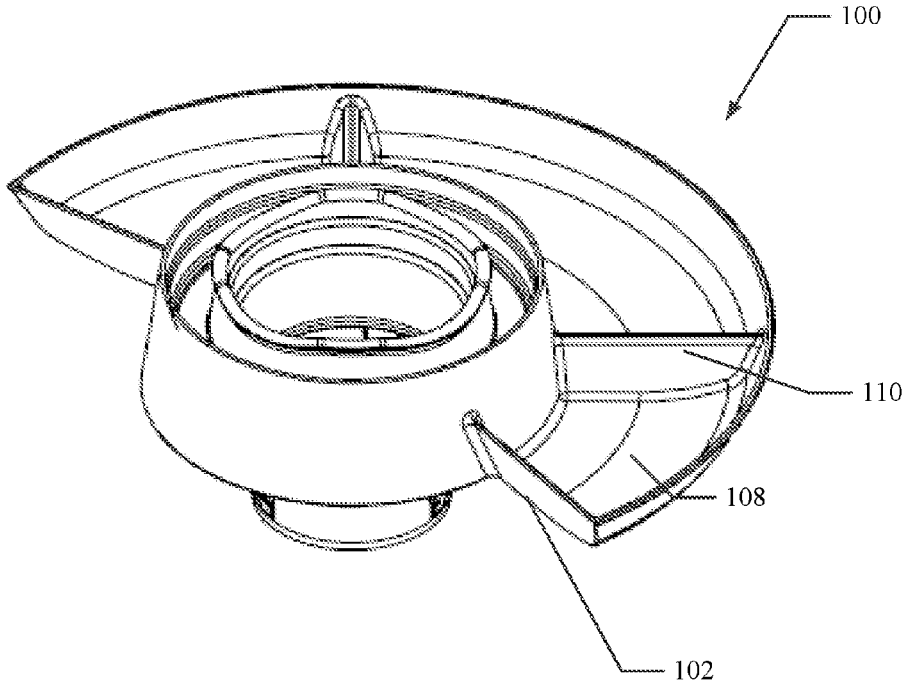
FIG. 13*b* depicts a perspective view of the embodiment of the combination plate and cup holder depicted in FIG. 13*a*, with the cup holder in the lowered position.
Figure 13C:
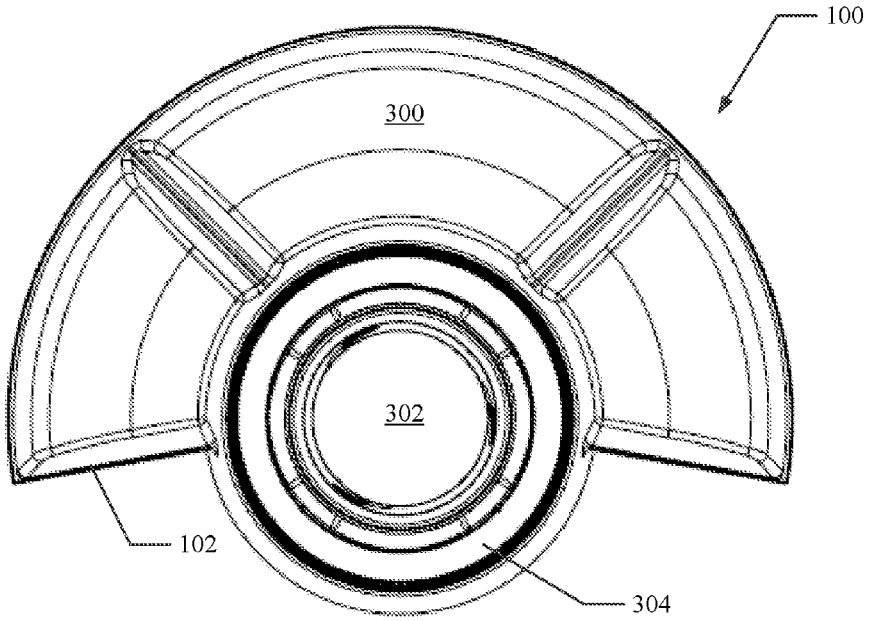
FIG. 13*c* depicts, from below, the embodiment of the combination plate and cup holder depicted in FIG. 13*a*.
Figure 13D:
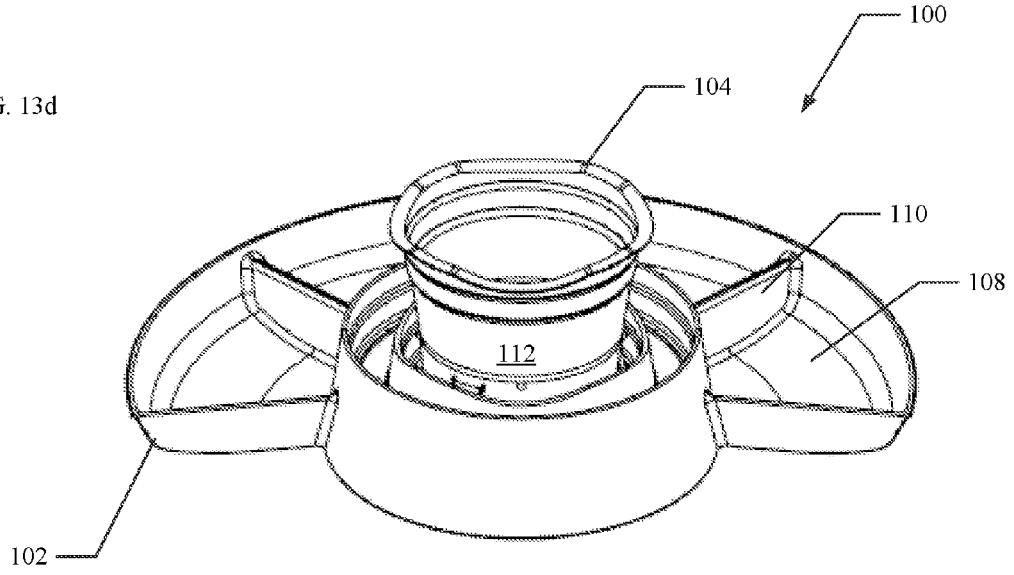
FIG. 13*d* depicts a perspective view of the embodiment of the combination plate and cup holder depicted in FIG. 13*a*.
Figure 14A:
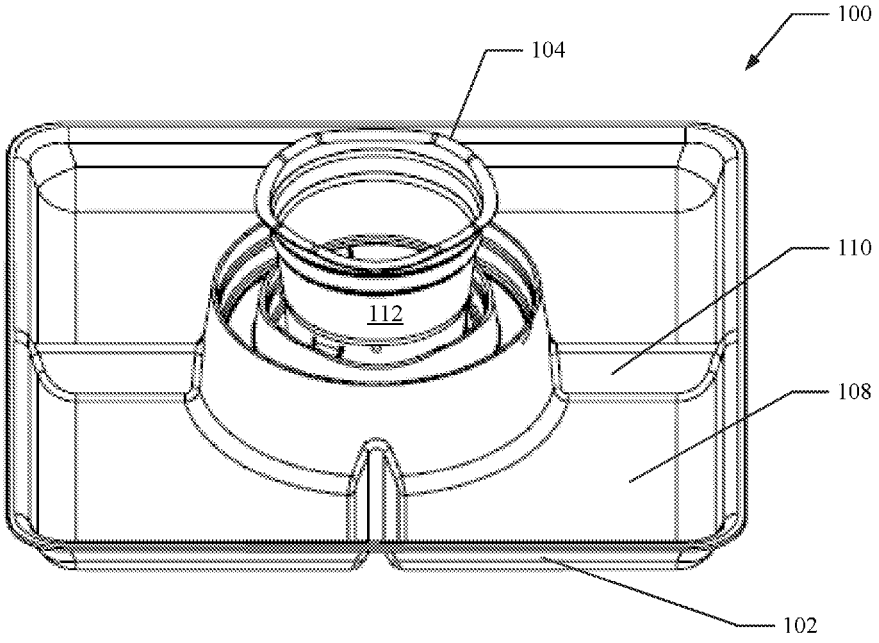
FIG. 14*a* depicts a perspective view of another embodiment of the combination plate and cup holder, with the cup holder in the raised position.
Figure 14B:
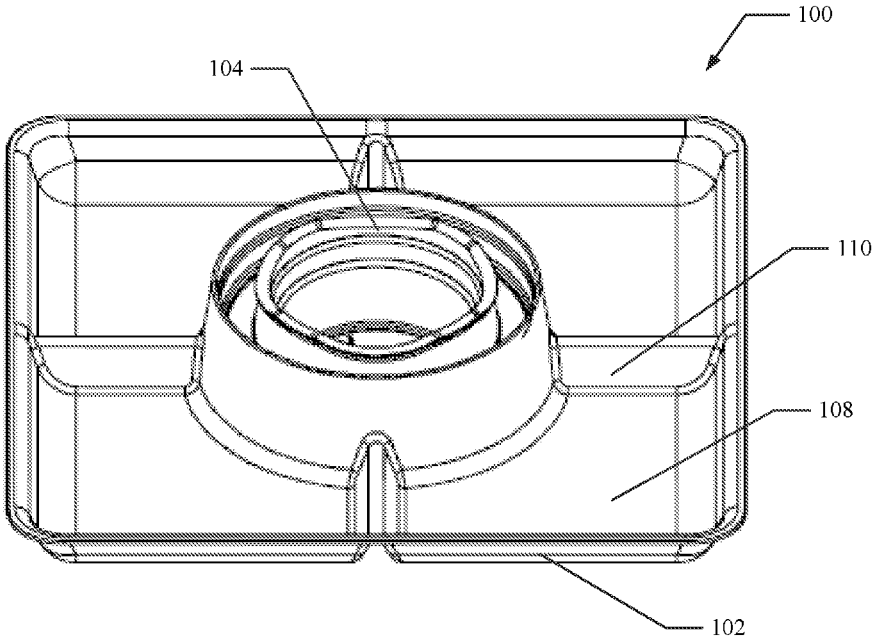
FIG. 14*b* depicts a perspective view of the embodiment of the combination plate and cup holder depicted in FIG. 14*a*, with the cup holder in the lowered position.
Figure 14C:
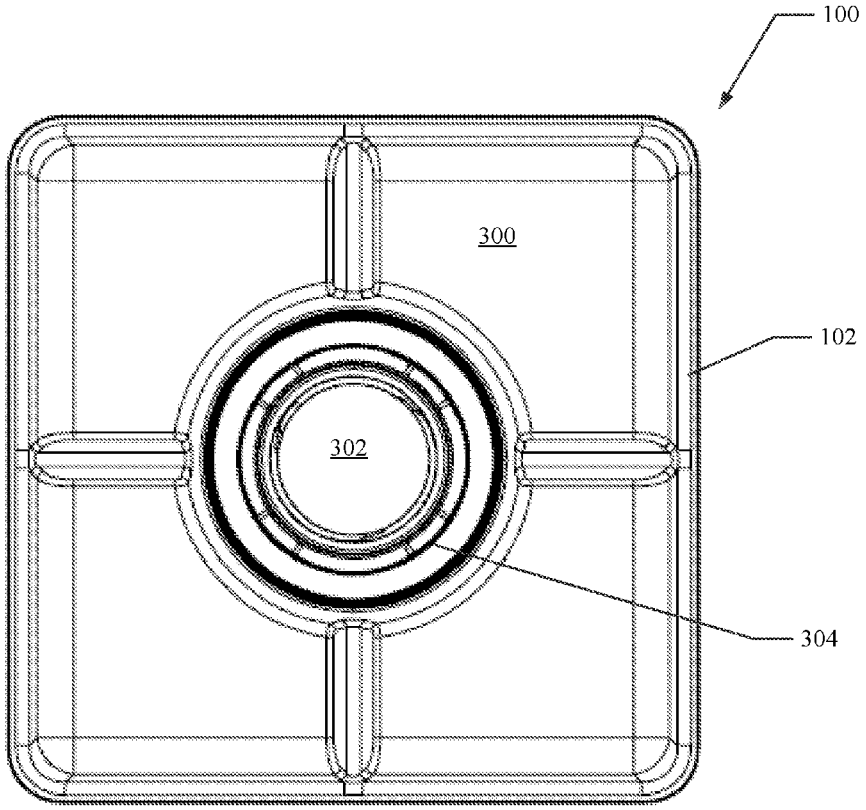
FIG. 14*c* depicts, from below, the embodiment of the combination plate and cup holder depicted in FIG. 14*a*.
Figure 14D:
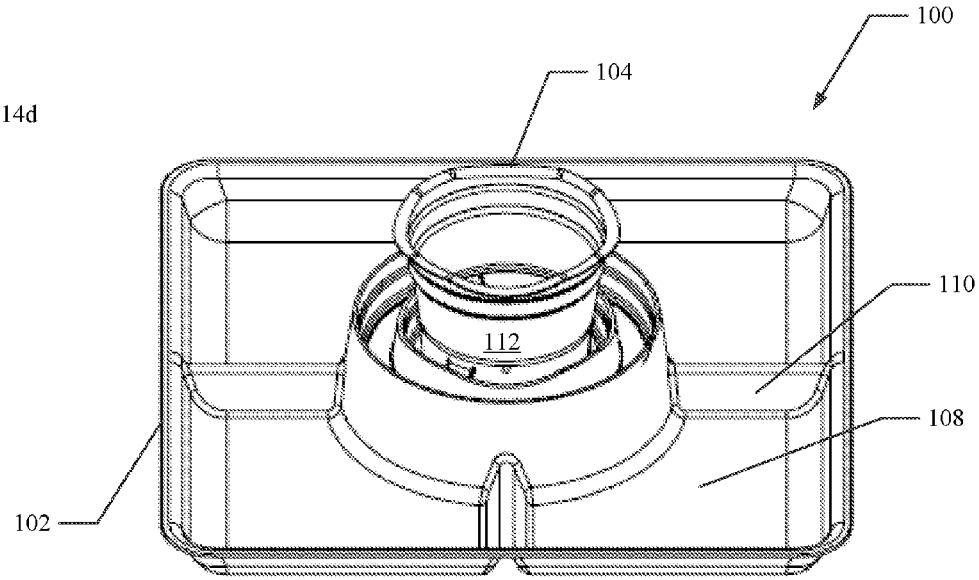
FIG. 14*d* depicts a perspective view of the embodiment of the combination plate and cup holder depicted in FIG. 14*a*.

Referring now to FIGS. 11*a*, 11*b*, 12*a* and 12*b*, in embodiments, the combined plate and cup holder 100 contains a locking mechanism that holds the cup holder 104 in the lowered position, where the cup holder 104 is lowered with respect to the plate 102. In this embodiment, the fixed sides 112 of the cup holder 104 have one or more knobs 1100 or protrusions. The wall 402 along the aperture 106 of the plate 102 has one or more notches 1102, as shown in FIG. 11*b*, the notch 1102 can have a higher side and a lower side. The notch 1102 is located along a bottom edge of the wall 402. When the combined plate and cup holder 100 is transitioning between the raised position and the lowered position, the wall 400 includes a channel proximate to the higher side of the notch 1102 that accommodates the height of the knob 1100 such that the cup holder 104 may freely move up and down. In another embodiment, the channel is unnecessary due to the angle of the wall 402. In this embodiment, the wall 402 is larger in diameter at its top than it is at its bottom. As a result, at the top of the notch 1102 the diameter of the wall 402 is larger than that of the cup holder 104 with the knob 1100. When in the lowered position, the plate 102 can be turned so that the knob 1100 aligns with the lower side of the notch 1102. As seen in FIGS. 12*a* and 12*b*, the lower side does not include a channel, cannot accommodate the height of the knob 1100 and thus abuts the knob 1100, preventing the plate 102 from sliding down with respect to the cup holder 104 and locking the combined plate and cup holder 100 in the lowered position. In this embodiment, the user may grasp the cup holder 104 when the combined plate and cup holder 100 is in the lowered position and the plate 102 will maintain this position above the user's grip, even without the user providing support directly to the plate 102.

When the user wishes to dispose the cup holder 104 in the raised position, the user may twist the plate 102 so that the knob 1100 aligns with the higher side of the notch 1102 and the channel, allowing the cup holder 104 to easily slide up in the aperture 106.

Referring to FIGS. 13*a*-13*d*, another embodiment of the combination plate and cup holder 100 is illustrated. In the depicted embodiment, the portion of the plate 102 proximate to the aperture is generally the same configuration as the embodiment illustrated in FIG. 1, while the overall shape of the plate 102 is generally that of a half circle. This embodiment could be useful when utilizing the combined plate and cup holder 100 with a standard cup holder in a seat at a stadium or other venue. This would allow the user to position the cup holder 104 in the standard armrest cup holder, which would then support the entire combined plate and cup holder, without intruding on the space of another seat.

Referring to FIGS. 14*a*-14*d*, in other embodiments, the plate 102 can be generally square or rectangular in shape. As shown, the plate 102 can be formed with generally rounded corners, and with the aperture substantially in the center of the plate 102. In other embodiments, the plate 102 can be hexagonal, elliptical, irregularly shaped, or any other shape or configuration suitable for supporting food. Similarly, in other embodiments, the aperture 106 and cup holder 104 can be positioned anywhere with respect to the plate 102. For example, the aperture 106 and cup holder 104 can be positioned adjacent to the periphery of the plate or even simply attached to the side of the plate rather than being bounded by the plate on all sides.

While the aperture 106 is generally shown as circular and the cup holder 104 is illustrated as cylindrical, any suitable shapes can be used. For example, a square, hexagonal or octagonal aperture 106 could be used where the cup holder 104 would be shaped to sit within the aperture 106, and slide vertically between the raised and lowered positions.

In embodiments, the combined plate and cup holder 100 and any of its component parts can be formed from a variety of materials, including but not limited to pressed molded fiber or pulp, disposable plastic, durable plastic. For example, a recyclable version could be manufactured from molded fiber or recycled materials. This version could be disposable or single use, sold at venues. Other embodiments can be formed from polymers or plastics that allow the combined plate and cup holder 100 to be cleaned and reused. These embodiments can also be decorated with marks or designs specific to the events or preferences of the user (e.g, favorite sports team).

What has been described above includes examples of aspects of the claimed subject matter. It is, of course, not possible to describe every conceivable combination of components or methodologies for purposes of describing the claimed subject matter, but one of ordinary skill in the art may recognize that many further combinations and permutations of the disclosed subject matter are possible. Accordingly, the disclosed subject matter is intended to embrace all such alterations, modifications and variations that fall within the spirit and scope of the appended claims. Furthermore, to the extent that the terms "includes," "has" or "having" or variations in form thereof are used in either the detailed description or the claims, such terms are intended to be inclusive in a manner similar to the term "comprising" as "comprising" is interpreted when employed as a transitional word in a claim.

What is claimed is:

1. A device for holding food and drink, the device comprising:

a cup holder with a fixed side and a base, the cup holder configured to support a drink container; and a plate for supporting food, the plate comprising an aperture in which the cup holder is seated and the cup holder is moveable within the aperture, so that the device can be disposed in a lowered position, wherein the cup holder is lowered with respect to the plate, or in a raised position, wherein the base of the cup holder is substantially coplanar with a base of the plate, wherein the cup holder comprises one or more tabs situated substantially near the base of the cup holder such that the protrusions will abut the edge of the aperture when the device is in the raised position, preventing the cup holder from disengaging with the aperture.

2. The device of claim 1, wherein the aperture is located substantially near a center of the plate.

3. The device of claim 1, wherein the aperture is located near a periphery of the plate.

4. The device of claim 1, wherein the device is constructed of material selected from the group consisting of polymers and molded fiber.

5. The device of claim 1, wherein the plate has at least one divider that separates a top of the plate into compartments.

6. The device of claim 1, further comprising an indentation in a bottom of the plate, the indentation proximate to the aperture.

7. The device of claim 1, further comprising a lip of the cup holder such that an edge of the aperture will abut the lip when the cup holder is in the lowered position, preventing the cup holder from disengaging with the aperture.

8. The device of claim 1, further comprising a locking mechanism that locks the plate in a fixed position with respect to the cup holder.

9. The device of claim 1, further comprising a wall along a perimeter of the aperture, the wall stabilizing the cup holder when the cup holder is in the raised position.

10. A device for holding food and drink, the device comprising:

a cup holder with a fixed side and a base, the cup holder configured to support a drink container; and a plate for supporting food, the plate comprising an aperture in which the cup holder is seated and the cup holder is moveable within the aperture, so that the device can be disposed in a lowered position, wherein the cup holder is lowered with respect to the plate, or in a raised position, wherein the base of the cup holder is substantially coplanar with a base of the plate, further comprising a wall along a perimeter of the aperture, the wall stabilizing the cup holder when the cup holder is in the raised position, wherein the side of the cup holder comprises of one or more engagement flanges, situated near the base of the cup holder such that the engagement flanges will abut the sides of the wall of the aperture when the cup holder is in the raised position, preventing the cup holder from disengaging with the aperture.

* * * * *